US005772349A

United States Patent [19]

Tubergen

[11] Patent Number: 5,772,349

[45] Date of Patent: Jun. 30, 1998

[54] GREETING CARD ALBUM

[76] Inventor: Matthew Alan Tubergen, 8491 Whipporwill, Apt. F., Indianapolis, Ind. 46256

[21] Appl. No.: 515,508

[22] Filed: Aug. 15, 1995

[51] Int. Cl.[6] ..... B42F 3/00

[52] U.S. Cl. ..... 402/79; 402/80 R; 402/80 P; 281/38; D19/27

[58] Field of Search ..... 281/35, 22, 38, 281/31; 402/79, 80 R, 80 P; 40/776, 771; D19/27, 26, 1; 283/117; 428/14

[56] References Cited

U.S. PATENT DOCUMENTS

| | | | |
|---|---|---|---|
| D. 261,155 | 10/1981 | Nast | D19/33 |
| D. 262,891 | 2/1982 | Nast | D19/33 |
| D. 311,208 | 10/1990 | Folson | D19/27 |
| D. 312,476 | 11/1990 | Westendorff | D19/26 X |
| D. 314,977 | 2/1991 | Wyant | D19/27 |
| 3,470,643 | 10/1969 | Koeppe et al. | 40/775 X |
| 4,326,349 | 4/1982 | Daughtry | 40/661 X |
| 4,629,349 | 12/1986 | Pitts | 281/31 |
| 4,771,557 | 9/1988 | Bowman | 40/661 X |
| 4,810,544 | 3/1989 | Hickman | 40/661 X |
| 4,829,691 | 5/1989 | Manjos et al. | 40/661 |
| 4,925,720 | 5/1990 | Hansen | 40/661 X |
| 4,952,091 | 8/1990 | Sirko | 402/79 |
| 5,245,775 | 9/1993 | Goserud | 40/776 X |
| 5,323,552 | 6/1994 | Fritz | 40/776 X |
| 5,323,553 | 6/1994 | Candido | 40/661 X |
| 5,329,324 | 7/1994 | Candido | 40/776 X |
| 5,335,027 | 8/1994 | Lin et al. | 402/79 X |

FOREIGN PATENT DOCUMENTS

| | | | |
|---|---|---|---|
| 2524676 | 10/1983 | France | 40/661 |
| 2844508 | 6/1979 | Germany | 402/79 |

OTHER PUBLICATIONS

Miller's Office Products Catalog, pp. 528–529, Sheet Protectors, 1989.

*Primary Examiner*—Frances Han
*Attorney, Agent, or Firm*—Conley, Rose & Tayon, P.C.

[57] ABSTRACT

A protective sleeve or jacket for displaying and storing a greeting card or other similarly folded flat object such as a program, announcement or invitation is disclosed. The sleeve is made from a single rectangular sheet of transparent synthetic polymeric film, such as polypropylene, incorporating five parallel transverse folds. Narrow binding flaps project from the back of the sleeve and provide a means for binding the sleeve as a page in an album. The greeting card is inserted through the open top or bottom of the sleeve and the card's center fold is aligned with the center fold of the sleeve. An album containing one or more of these sleeve pages is also disclosed.

17 Claims, 3 Drawing Sheets

GREETING CARD ALBUM

BACKGROUND OF THE INVENTION

A. Field of the Invention

This invention relates generally to albums and particularly to albums having transparent sleeves or jackets for protecting and displaying greeting cards and the like, and still more particularly to such sleeves or jackets adapted as pages bound in an album.

B. Description of the Related Art

The sending and receiving of greeting cards is a popular custom in the United States. On holidays and other special occasions a recipient often has numerous greeting cards to display. Various methods of displaying greeting cards are known, including grouping in a basket, arranging on a table, suspending on a string, framing or placing in an album.

Some people like to not only display their current greeting cards but save them from year to year. Because people have exchanged greeting cards and the like for many years, collections of great sentimental value or that are quite old or rare exist. These collectors often find it desirable to store their cards in such a way that they are protected from being damaged yet still accessible for viewing. Conventional ways of storing and protecting the cards include bundling or stacking the cards in a drawer or box, or mounting in a photograph-type album.

Jackets or sleeves of transparent material for mounting photographs, baseball cards and the like are known. It is also known to make multiple jackets or sleeves in the form of a page in a loose leaf binder or some other kind of display.

Des. U.S. Pat. No. 311,208 (Folson) discloses a greeting card album with transparent pages having pockets into which the ends of an open card are inserted.

Certain prior art transparent sleeves do not permit viewing of a card from all four sides without removing it from the sleeve. Repeated direct handling of the card leads to soiling and wear. A disadvantage of some plastic pages is that they do not cover all of the surfaces of the card, leaving some parts unprotected or not sufficiently held in place. Other conventional holders require that the card be displayed closed or completely spread open, preventing opening and closing of the card as originally intended. In fact, for some cards to be enjoyed, the faces of the card must be viewed in sequence. For example, the front of the card sets up a joke and the inside message delivers the punch line. Opening and closing are also important requirements for cards that have moving members or that actuate a musical microchip upon opening.

Cards with special qualities such as antique cards, those with exceptional art work or those that convey a special message, musical cards and cards that have three dimensional projections particularly require a better way to be displayed.

The present invention overcomes the deficiencies of the prior art.

SUMMARY OF THE INVENTION

It is therefore an object of this invention to provide a transparent sleeve that covers the entire card and allows all four sides of the card to be displayed without being removed from the sleeve. Another object of this invention is to provide a binder album containing one or more such interchangeable sleeves as separate pages.

The present invention is a transparent sleeve or jacket for holding a single greeting card, or the like. The sleeve is made from one rectangular sheet of transparent synthetic polymer film that is folded across its length in five places to form two front panels and two back panels. Each back panel is folded outward near its edge to make a narrow flap. The flaps are placed or secured back-to-back, thereby forming a sleeve that is open at its top and bottom edges. The sleeve has another transverse fold at about the middle of the front. The sleeve's front fold meets the junction of the back flaps when the sleeve is flattened or when the sleeve is folded closed. An open card's fold is disposed between the sleeve's front fold and the junction of the two back folds so that the jacketed card can be opened and closed normally. The protective sleeve of the present invention is also suitable for protecting and displaying other memorabilia that is, or lends itself to be, folded, such as programs, announcements, invitations and brochures.

The sleeve's flaps also provide means for attachment to a binder, each sleeve serving as a separate page. A plurality of pages may be bound together by their flaps or may be organized as loose leaves in an album.

Other objects and advantages of the present invention will appear from the following description.

BRIEF DESCRIPTION OF THE DRAWINGS

For a detailed description of a preferred embodiment of the invention, reference will now be made to the accompanying drawings wherein.

DESCRIPTION OF PREFERRED EMBODIMENTS

For the purpose of illustration the invention will be described for use with a greeting card, but it will be apparent by those of skill in the art that the page and album described herein are readily adaptable for use with other essentially flat, foldable objects to be displayed or stored such as booklets, programs, invitations, announcements and the like.

Figure 1:
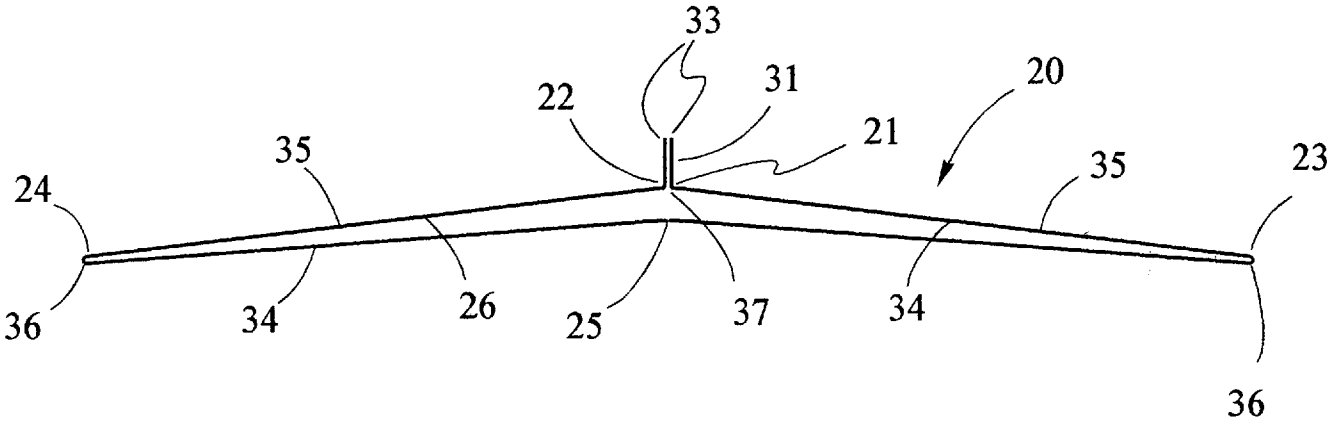
FIG. 1. is an end view of either end of the sleeve of the present invention shown in its substantially fully open position.

Referring initially to FIG. 1, a sleeve 20 is made from one or more sheets of suitable synthetic transparent film material, such as polypropylene. Any synthetic material may be used which provides sufficient clarity, durability and archival quality for the intended use. Optionally, sleeve 20 may be made of a material that also does not promote deterioration of the card material or that has uv-protective or insect deterring properties. The thickness of the film from which the sleeve is made is about 0.2 mils, or it may be of any suitable thickness that provides a sleeve of the desired weight, strength and foldability.

Figure 2:
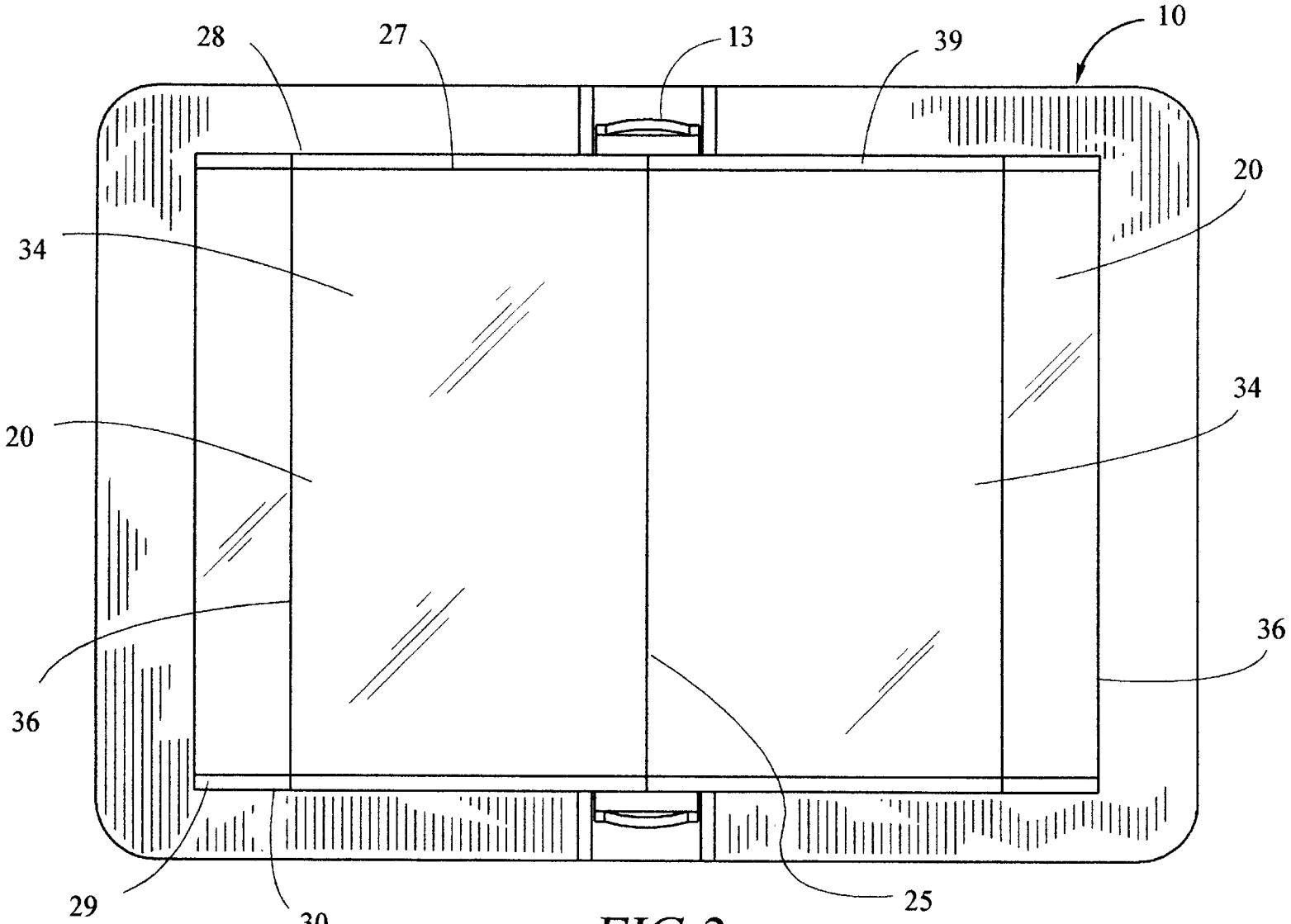
FIG. 2. is an elevation view of one embodiment of the present invention showing a sleeve page of an album in the fully open position.

In the preferred embodiment of the present invention, a single rectangular sheet of transparent film is used. The transparent sheet incorporates five parallel folds 21–25 transverse to the longitudinal length of the rectangular sheet to form sleeve 20. According to one method of constructing the sleeve of the present invention, the sheet is first folded transversely, preferably from midpoint to midpoint of each longitudinal edge, forming fold 25, and back edges or ends 33 are brought together. Parallel second and third folds are then made near each vertical end 33 to form folds 21,22, thereby forming narrow binding flaps 31 which project away from interior space 26 of sleeve 20 when flaps 31 are held back to back. Flaps 31 may be secured together by any suitable conventional method, such as glue, adhesive or thermal bonding. Reinforcement material may be bonded to flaps 31, if desired. Fourth and fifth folds 23,24 are formed as center fold 25 is brought together with back folds 21,22 creating quarter panels consisting of two back panels 35 and two integral front panels 34. Panels 34,35 are substantially of the same size. However, as shown in FIG. 2, the height of front panels 34 may be reduced to form a small flap 39 to facilitate opening the top of sleeve 20 for the insertion of a card. The folding of the rectangular sheet into sleeve 20 and the bonding of the flaps 31 may be accomplished by a conventional mass production method well known in the art, if desired.

In another embodiment, sleeve 20 is constructed from two rectangular sheets of film. In that embodiment, bottom edges 29,30 are closed by heat sealing and front panels 34 are not integral at ends 36 with back panels 35, sleeve ends 36 being closed by heat sealing instead of folds 23,24. Sleeve 20 may also be constructed from more than two pieces of film, if desired, substituting a seam or sealed edge for one or more of folds 21–25.

In still another embodiment of the present invention, flaps 31 are not secured together, top edges 27,28 and bottom edges 29,30 are both closed, and a card is inserted, partially folded, into sleeve 20 at a back opening 37 adjacent flaps 31.

The optimum dimensions of sleeve 20 can be readily determined from the maximum size of the card to be inserted. Sleeve 20 is sized such that the card is snugly contained and does not tend to fall out when sleeve 20 or album 10, containing multiple pages, is manipulated or stood on end. As can be readily seen, smaller cards are accommodated by oversized sleeves by positioning the card's center fold against center fold 25 of sleeve 20. An oversized sleeve is also appropriate for cards folded off center or to accommodate some fullness of the inserted item, such as a booklet opened to a selected part or a card having a three dimensional projection or a moveable part. Somewhat oversized sleeves allow musical cards to be enjoyed without removal from album 10.

Referring now to FIGS. 1 and 2, the sleeve of the present invention may be open at both the top and bottom edges 27,29, but either or both may be closed by any suitable method, if desired. In the preferred embodiment, bottom edges 29,30 are heat sealed, an open card is inserted between top edges 27,28 of sleeve 20, substantially fully extended, and the card is aligned so that the card's center fold coincides with fold 25 of the sleeve. The card is held in place when sleeve 20 is folded closed. Preferably, the card is also held in place by sealed bottom edges 29,30. Sleeve 20 containing the card may be used in an album 10, or separately, for example, stacked for protective storage.

Figure 3:
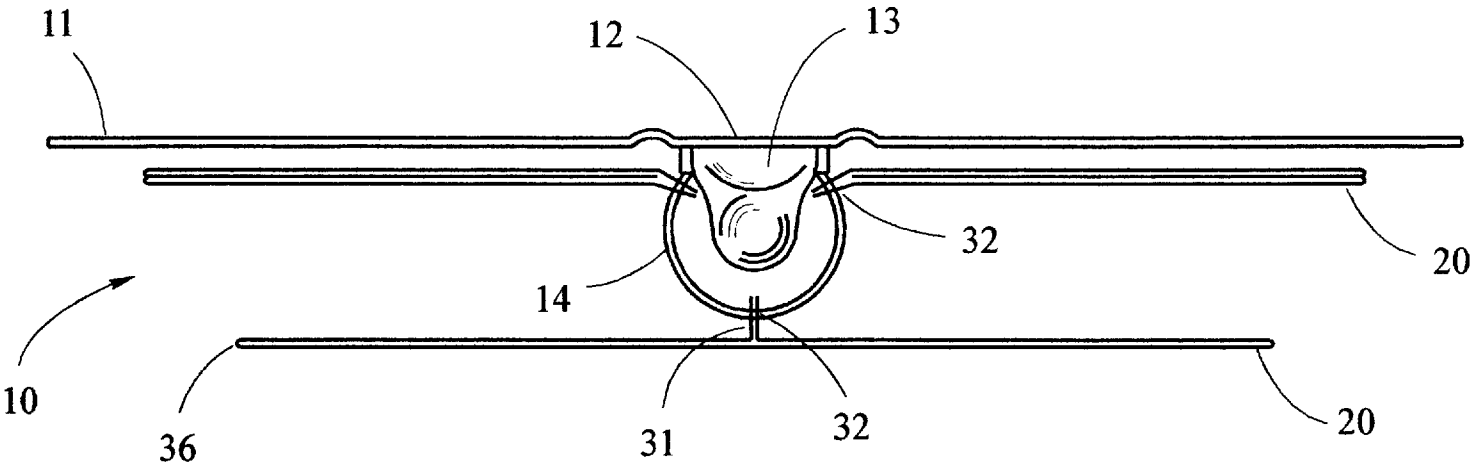
FIG. 3. is an end view of either end of a loose leaf ring binder album embodiment of the present invention, showing three sleeve pages.

As shown in FIG. 3, the sleeve flaps 31 may be hole punched to provide holes 32 for insertion of one or more sleeves into a conventional loose leaf ring binder 11. Optionally, a plurality of sleeves may be secured by their flaps in any of a variety of known binders, or the sleeves may be used unbound.

While a preferred embodiment of the invention has been shown and described, modifications thereof can be made by one skilled in the art without departing from the spirit and teachings of the invention. The embodiment described herein is exemplary only, and is not limiting. Many variations and modifications of the invention and apparatus disclosed herein are possible and are within the scope of the invention. Accordingly, the scope of protection is not limited by the description set out above, but is only limited by the claims which follow, that scope including all equivalents of the subject matter of the claims.

What is claimed is:

1. A holder for a folded card comprising:

a sleeve of transparent plastic forming front and back panels;

said front panel having a center fold adapted for alignment with the fold of the card;

said back panel having a vertical center opening defined by a pair of opposing flaps; and said panels having top and bottom edges and an opening between said top edges, said opening being transverse to said center fold.

2. A holder for a folded card comprising:

a sleeve consisting of a single sheet of transparent plastic forming front and back panels;

said front panel having a center fold adapted for alignment with the fold of the card;

said back panel having a vertical center opening defined by a pair of opposing flaps; and said sleeve having an opening between top edges of said panels, said opening being transverse to said center fold.

3. The holder of claim 1 wherein said front and back panels are formed by end folds in said transparent plastic.

4. The holder of claim 1 wherein said bottom edges are thermal sealed.

5. A holder for a folded card comprising:

a single rectangular sheet of transparent plastic having upper and lower longitudinal edges and first and second vertical ends;

said first and second vertical ends having parallel folds adjacent said vertical ends forming opposing end flaps, said parallel folds defining a central back opening;

said sheet having quarter panel folds between said parallel folds defining a pair of front panels and a pair of back panels; and said lower longitudinal edges being heat sealed to form a sleeve.

6. A sleeve for a greeting card having an interior fold comprising at least one sheet of synthetic polymer film, said sleeve comprising:

a front having a vertical central fold;

two back members, each terminating in a flap;

an interior space defined by said front and two back members;

a top edge; and a bottom edge, said front being joined to each said back member and said flaps being disposed back-to-back, projecting away from said interior space, and defining a vertical central opening between said two back members.

7. The sleeve of claim 6 wherein said flaps are adapted for attaching to a binder.

8. The sleeve of claim 7 wherein said flaps comprise reinforcing material and are hole punched for attaching to said binder.

9. The sleeve of claim 6 wherein at least one of said top and bottom edges is closed.

10. The sleeve of claim 6 wherein said sleeve comprises one sheet of transparent synthetic polymer film and said front is integral with said back members.

11. The sleeve of claim 10 wherein said sleeve further comprises five parallel transverse folds, the first of said folds being disposed in the center of said front, said second and third folds being each disposed near a back terminus and defining one of said flaps, and said fourth and fifth folds being each disposed at a point where said front integrates with said back opposite a flap.

12. The sleeve of claim 6 wherein said vertical central fold is adapted for engaging the interior fold of a greeting card.

13. The sleeve of claim 6 wherein said top edge comprises an opening and said bottom edge is sealed.

14. An album containing at least one replaceable page for holding a greeting card having an interior fold, each said page comprising a sleeve formed from at least one sheet of transparent synthetic polymer film, each said sleeve comprising;

a front having a vertical central fold;

two back members, each terminating in a flap;

an interior space defined by said front and two back members;

a top edge; and a bottom edge, said front being joined to each said back member and said flaps being disposed back-to-back, projecting away from said interior space, and defining a vertical central opening between said two back members.

15. The album of claim 14 wherein said sleeve comprises a single sheet of transparent synthetic polymer film and said front is integral with each said back member.

16. The album of claim 14 wherein said vertical central fold is adapted for engaging the interior fold of a greeting card.

17. The album of claim 14 further comprising:

a binder having binder rings disposed along a central fold region of said binder, said binder and binder rings being adapted for releasably connecting to the back flaps of said sleeve, said back flaps comprising holes adapted for receiving said binder rings, wherein the back members of said sleeve together define a back central opening adjacent said flaps, said back central opening and said front central fold are adapted for alignment with the fold of a card when the card is placed into the sleeve, said sleeve further comprising first and second sleeve portions whereby said first sleeve portion receives one part of the card on one side of the fold of the card and said second sleeve portion receives the other part of the card on the other side of the fold of the card; and wherein the top of said sleeve comprises open front and back edges transverse to said front central fold and adapted for being transverse to the fold of the card and the central fold region of the binder.

* * * * *